US007891928B2

(12) United States Patent
Harada

(10) Patent No.: US 7,891,928 B2
(45) Date of Patent: Feb. 22, 2011

(54) FOLDED PORTION FLATTENING DEVICE, POST TREATMENT APPARATUS AND IMAGE FORMING APPARATUS

(75) Inventor: Katsunori Harada, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 536 days.

(21) Appl. No.: 11/511,479

(22) Filed: Aug. 29, 2006

(65) Prior Publication Data

US 2007/0081876 A1 Apr. 12, 2007

(30) Foreign Application Priority Data

Oct. 7, 2005 (JP) ..... 2005-294427

(51) Int. Cl.

| | |
|---|---|
| ***B42D 1/00*** | (2006.01) |
| ***B42D 3/00*** | (2006.01) |
| ***B42C 9/00*** | (2006.01) |
| ***B42C 11/00*** | (2006.01) |
| ***B42C 11/02*** | (2006.01) |
| ***B42C 13/00*** | (2006.01) |
| ***B42B 5/00*** | (2006.01) |

(52) U.S. Cl. ..... 412/13; 281/21.1; 281/29; 412/1; 412/4; 412/5; 412/9; 412/18; 412/19; 412/22; 412/33

(58) Field of Classification Search ..... 156/479, 156/908; 206/389, 411; 270/37, 52.18, 58.08; 271/99; 281/15.1, 21.1, 29; 412/1, 3, 4, 412/5, 6, 8, 9, 18, 19, 22, 23, 30, 33, 37, 412/900, 901, 902, 13; 493/334, 384; *B42B 5/00; B42C 11/00*

See application file for complete search history.

(56) References Cited

U.S. PATENT DOCUMENTS

| | | | | |
|---|---|---|---|---|
| 2,088,904 | A | 8/1937 | Grammer | |
| 5,779,423 | A * | 7/1998 | Bermingham | 412/4 |
| 6,637,996 | B1 * | 10/2003 | Hayakawa et al. | 412/9 |
| 6,692,208 | B1 * | 2/2004 | Watkiss et al. | 412/1 |
| 7,431,274 | B2 | 10/2008 | Kushida et al. | |
| 7,673,862 | B2 | 3/2010 | Kushida et al. | |
| 2003/0031532 | A1 | 2/2003 | Nolte et al. | |
| 2005/0179190 | A1 | 8/2005 | Kamiya et al. | |
| 2005/0191154 | A1 | 9/2005 | Fujimoto et al. | |

FOREIGN PATENT DOCUMENTS

| | | |
|---|---|---|
| JP | 2001-260564 | 9/2001 |
| JP | 2005-239414 | 9/2005 |

* cited by examiner

*Primary Examiner*—Dana Ross
*Assistant Examiner*—Justin V Lewis
(74) *Attorney, Agent, or Firm*—Morgan, Lewis & Bockius LLP

(57) ABSTRACT

A folded portion flattening device has: a sheet conveying section that conveys a booklet of folded sheets in a predetermined conveyance direction with a folded portion ahead; a sheet stopper that stops the booklet conveyed by the sheet conveying section at a fixed position; a pair of booklet holding members that hold the booklet stopped by the sheet stopper by gripping the booklet at both faces of the booklet; a pressing member that presses the front end of the folded portion of the booklet held by the booklet holding members in an opposite direction to the conveyance direction, so that a curve at the front end of the folded portion is flattened to form a flat face; and a wrinkle preventing member that prevents wrinkle from being generated in the flat face when pressed by the pressing member.

3 Claims, 4 Drawing Sheets

FOLDED PORTION FLATTENING DEVICE, POST TREATMENT APPARATUS AND IMAGE FORMING APPARATUS

BACKGROUND (i) Technical Field

The present invention relates to a folded portion flattening device built in a post treatment apparatus which executes a variety of post treatments on a sheet in which an image is formed with an image forming apparatus, the post treatment apparatus and the image forming apparatus.

(ii) Related Art

Recently, image forming apparatuses have been often used on line and post treatment apparatuses for executing a variety of post treatments such as stapling, binding and punching on a sheet in which an image is formed have been widely used.

For example, FIG. 1 shows an image forming apparatus 1 such as electrophotographic printer, copying machine and a post treatment apparatus 2 for executing a variety of post treatments on a sheet in which an image is formed with the image forming apparatus 1, connected to this image forming apparatus 1. This post treatment apparatus 2 includes, for example, a transport unit 3 for receiving a sheet from the image forming apparatus 1, an intermediate treatment unit 4 for executing intermediate treatment such as folding, stapling, binding, interposing upon a sheet received by this transport unit 3, and a final treatment unit 5 for executing a variety of final treatments upon the sheet sent from the intermediate treatment unit 4.

The final treatment unit 5 includes, for example, a cutting section 6 for cutting out irregular portion at the rear end of a booklet folded in two, a folded portion flattening section 7 for flattening a curve of the folded portion at the front end of the booklet after cut, a punching treatment section 8 for punching near the front end of the booklet after flattened and a stacker section 9 in which the punched booklets are stacked.

When a booklet 10 folded in two by the intermediate treatment unit 4 is sent into the cutting section 6 of the final treatment portion with a folded portion 10*a* ahead as shown in FIG. 2, an irregular portion 10*b* at the rear end of the booklet 10 is cutout by a movable blade 6*a* and a fixed blade 6*b* of Guillotine cutter, a pressing type cutter which drops in the direction of an arrow, as shown in FIG. 2(*b*).

SUMMARY

According to an aspect of the invention, a folded portion flattening device includes: a sheet conveying section that conveys a booklet of folded sheets in a predetermined conveyance direction with a folded portion ahead; a sheet stopper that stops the booklet conveyed by the sheet conveying section at a fixed position; a pair of booklet holding members that hold the booklet stopped by the sheet stopper by gripping the booklet from both faces of the booklet; a pressing member that presses the front end of the folded portion of the booklet held by the booklet holding members in an opposite direction to the conveyance direction, so that a curve at the front end of the folded portion is flattened to form a flat face; and a wrinkle preventing member that prevents wrinkle from being generated in the flat face when pressed by the pressing member.

BRIEF DESCRIPTION OF THE DRAWINGS

Embodiments of the present invention will be described in detail based on the following figures, wherein.

DETAILED DESCRIPTION

Hereinafter, the embodiments of the present invention will be described with reference to the accompanying drawings.

Figure 1:
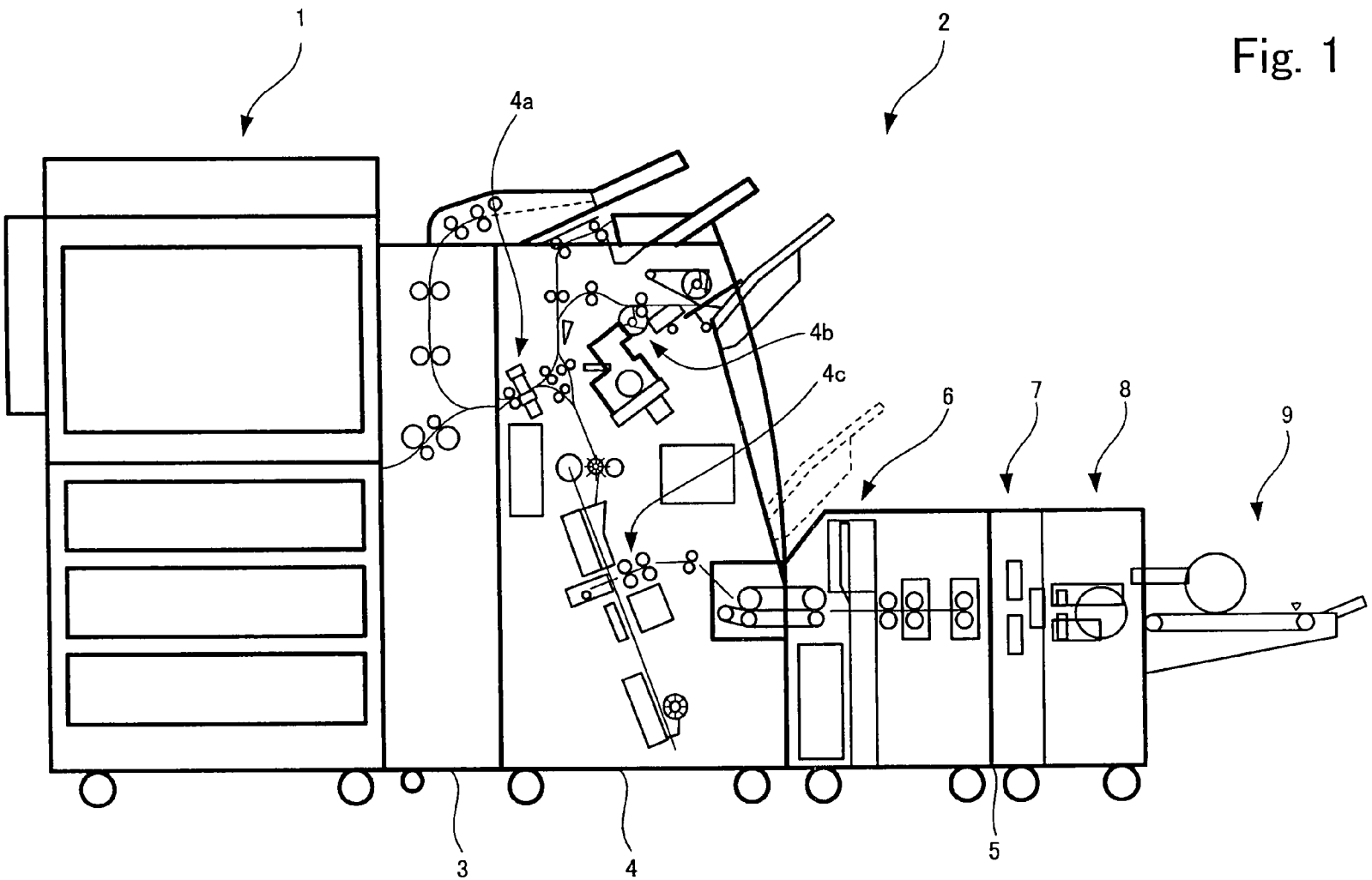
FIG. 1 is a schematic structure diagram showing an image forming apparatus including a folded portion flattening device of an embodiment.

FIG. 1 shows the post treatment apparatus 2 connected to the image forming apparatus 1 such as a printer and a copying machine. This post treatment apparatus 2 includes a transport unit 3 for receiving sheets from the image forming apparatus 1, a punching treatment section 4*a* for giving the punching treatment for a sheet received by the transport unit 3, a stapling section 4*b* for stapling, an intermediate treatment unit 4 having a folding portion 4*c* for folding a sheet, and a final treatment unit 5 for executing a variety of final treatments on a sheet sent from the intermediate treatment unit 4.

According to the exemplary embodiment, the image forming apparatus 1 corresponds to "the image forming section", and a combination of the image forming apparatus 1 and the post treatment apparatus 2 corresponds to "the image forming apparatus."

The final treatment unit 5 includes, for example, a cutting section 6 for cutting out an irregular portion at the rear end of a folded booklet, a folded portion flattening section 7 for flattening a curve at the front end of the folded portion after cut, a punching treatment section 8 for punching near the front end portion of the flattened booklet and a stacker section 9 in which the punched booklets are stacked.

Figure 2A:
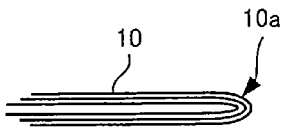
FIG. 2(*a*) through FIG. 2(*c*) show a schematic diagram of a cutting section built in a final treatment unit of a post treatment apparatus shown in FIG. 1.
Figure 2B:
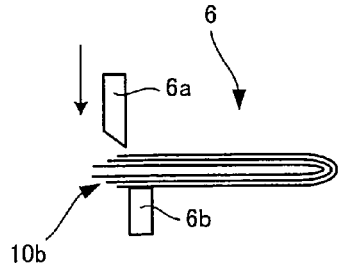
Figure 2C:
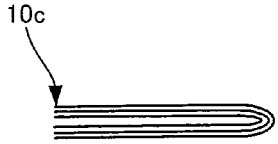

FIGS. 2(*a*) to 2(*c*) are schematic diagrams of the cutting section 6 built in the final treatment unit 5 of the post treatment apparatus 2 shown in FIG. 1. When a booklet 10 folded by the intermediate treatment unit 4 (see FIG. 1) is sent into the cutting section 6 of the final treatment unit 5 with its folded portion 10*a* ahead, the irregular portion 10*b* at the rear end of the booklet 10 is cut out with a movable blade 6*a* and a fixed blade 6*b* of a press type cutter which drops in the direction of an arrow as shown in FIG. 2(*b*). A rear end portion 10*c* of the booklet 10 is cut out neatly as shown in FIG. 2(*c*), so that a booklet 10 easy to page through is created.

Figure 3A:
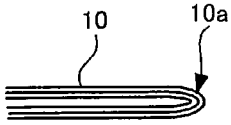
FIG. 3(*a*) through FIG. 3(*c*) show a schematic diagram of a folded portion flattening device built in the final treatment unit of the post treatment apparatus shown in FIG. 1.
Figure 3B:
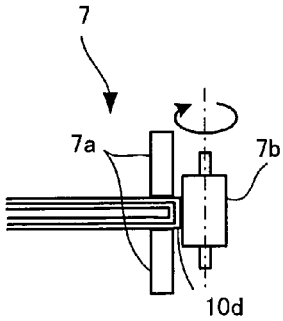
Figure 3C:
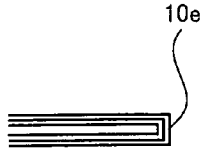

FIGS. 3(*a*) to 3(*c*) are schematic diagrams of the folded portion flattening device built in the final treatment unit 5 of the post treatment apparatus 2 shown in FIG. 1.

If the booklet 10 whose rear end is cut out by the cutting section 6 (see FIG. 4) is conveyed to the folded portion flattening section 7 with the folded portion 10*a* ahead as shown in FIG. 3(*a*), the booklet 10 is gripped and held at its both faces by a pair of booklet holding portions 7*a* disposed in the folded portion flattening section 7 as shown in FIG. 3(*b*). Next, the front end 10*a* of the folded portion is pressed by a roller 7*b* running along the longitudinal direction of the folded portion 10*a* while rotating in the direction of an arrow, so that the curve 10*d* at the front end is pressed and flattened, thereby forming a flat face 10*e* at the front end of the folded portion 10*a*.

The detail of the folded portion flattening device of the exemplary embodiment will be described with reference to FIG. 5.

Figure 4A:
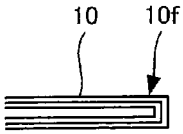
FIG. 4(*a*) through FIG. 4(*c*) show a schematic diagram of a punching treatment section built in the final treatment unit of the post treatment apparatus shown in FIG. 1.
Figure 4B:
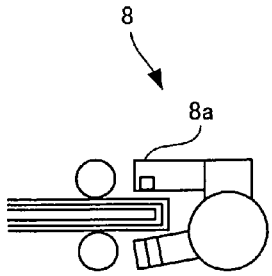
Figure 4C:
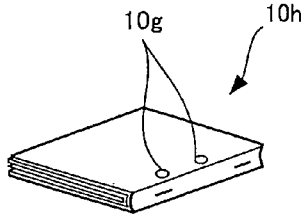

FIGS. 4(*a*) to 4(*c*) are schematic diagrams of the punching treatment section built in the final treatment unit of the post treatment apparatus shown in FIG. 1.

Figure 6:
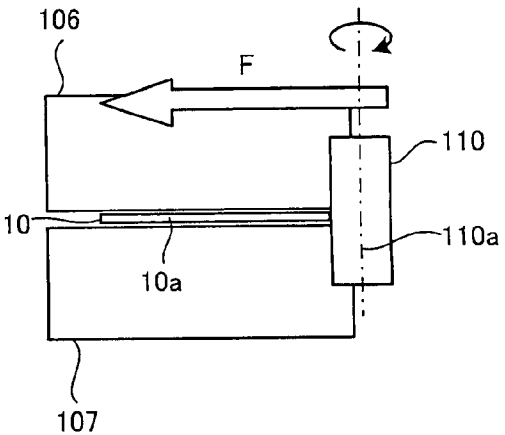
FIG. 6(*a*) through FIG. 6(*d*) show an action explanatory diagram of the folded portion flattening device shown in FIG. 5.
Figure 6:
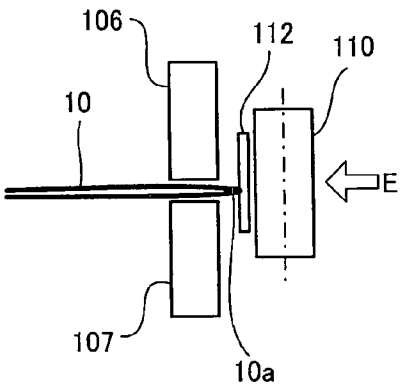
Figure 6:
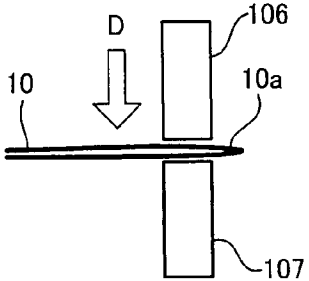
Figure 6:
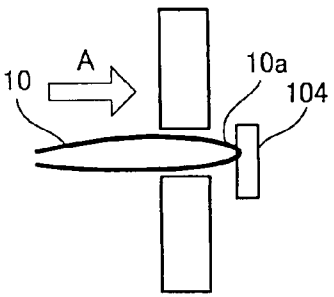

A booklet flattened by the folded portion flattening section 7 (see FIG. 3) is sent to the punching treatment section 8 as shown in FIG. 4(*a*) and given the punching treatment in the vicinity of a booklet front end portion 10*f* by a puncher 8*a*, so that punch holes 10*g* are formed as shown in FIG. 6(*c*) to complete a booklet 10*h*.

Figure 5:
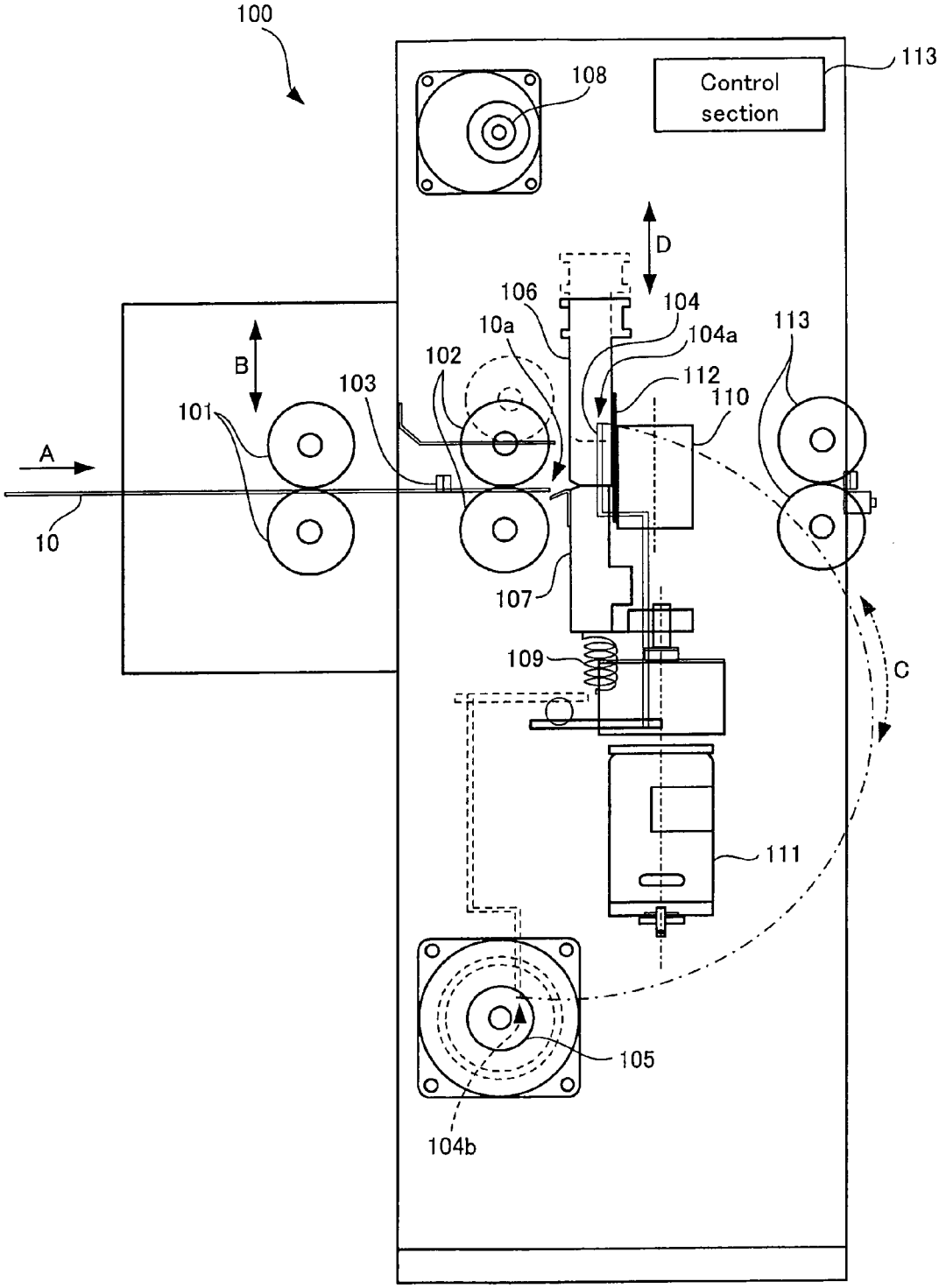
FIG. 5 is a detailed schematic structure diagram showing the folded portion flattening device.

FIG. 5 is a schematic structure diagram showing the folded portion flattening device.

In the following description, a folded portion flattening device 100 of FIG. 5 corresponds to the folded portion flattening device 7 of FIG. 1, a pair of booklet holding members 106, 107 of FIG. 5 correspond to the booklet holding members 7*a* of FIG. 3(*b*), and a roller 110 of FIG. 5 corresponds to the roller 7*b* of FIG. 3(*b*). The folded portion flattening device 100 is built in the final treatment unit 5 of the post treatment apparatus 2 shown in FIG. 1.

As shown in FIG. 5, the folded portion flattening device 100 includes sheet conveyance rollers 101 for conveying the booklet 10 consisting of plural sheets folded in two with the folded portion 10*a* ahead in a conveyance direction indicated with an arrow A, clamp rollers 102 for clamping the conveyed booklet 10, a sheet conveying section constituted of a sheet detecting sensor 103, a sheet stopper 104 for stopping the booklet conveyed by the sheet conveying section at a fixed position, a sheet stopper motor 105 for moving the sheet stopper 104 between an actuation position 104*a* and a retracted position 104*b* in the direction of an arrow C, a pair of booklet holding members 106, 107 for holding the booklet 10 stopped by the sheet stopper 104 at its both faces, a holding member drive motor 108 for moving one booklet holding member 106 in the direction of an arrow D, a spring 109 for pressing the other booklet holding member 107 against the booklet 10 and the roller 110 for pressing the front end of the folded portion 10*a* of the booklet 10 held by the booklet holding members 106, 107 in an opposite direction to the conveyance direction A and a curve at the front end of the folded portion 10*a* is flattened to form a flat face thereon. The folded portion flattening device 100 is also provided with a wrinkle preventing member for preventing wrinkles from being generated on the flat face due to pressing by the roller 110.

This wrinkle preventing member of the exemplary embodiment is constituted of a sheet-like member 112 disposed between the folded portion 10*a* of the booklet 10 held by the booklet holding members 106, 107 and the roller 110. The sheet-like member 112 is so constructed to move between the actuation position as shown in FIG. 5 and the retracted position (not shown) synchronously with a vertical motion of the booklet holding member 106.

According to the exemplary embodiment, the roller 110 corresponds to "the pressing member," consisting of a roller which runs while rotating and pressing the folded portion in the longitudinal direction thereof. In the meantime, this roller 110 is so constructed to be moved between the actuation position as shown in FIG. 5 and the retracted position (not shown) by a roller moving motor 111.

The folded portion flattening device 100 also includes a control section 113 that integrally controls each operation of the sheet conveyance roller 101, the clamp roller 102, the sheet detecting sensor 103, the sheet stopper 104, the sheet stopper motor 105, the booklet holding members 106, 107, the holding member drive motor 108, the roller 110, the roller moving motor 111 and the like.

Next, the operation of the folded portion flattening device 100 will be described with reference to FIG. 5 and FIGS. 6(*a*) through (*d*).

FIGS. 6(*a*) to 6(*d*) are action explanatory diagrams of the folded portion flattening device shown in FIG. 5.

When the booklet 10 consisting of plural sheets folded in two is sent with the folded portion 10*a* ahead as shown in FIG. 6(*a*), the sheet conveyance rollers 101 conveys the booklet 10 further in the direction of an arrow A. The clamp rollers 102 clamp the booklet 10 and continue to convey the booklet 10 in the direction of an arrow A together with the sheet conveyance roller 101. When the folded portion 10*a* reaches a fixed position, that is, the folded portion 10*a* comes into contact with the sheet stopper 104 that is moved up to the actuation position 104*a* shown in FIG. 5 by the sheet stopper motor 105, the conveyance of the booklet 10 is stopped.

In this conveyance process, the sheet detecting sensor 103 disposed in front of the clamp rollers 102 sends a detection signal to the control section 113 when it detects an advance of the booklet 10 and then, the control section 113 controls sheet conveyance by the sheet conveyance roller 101 and the clamp rollers 102 based on the detection signal from the sheet detecting sensor 103.

If the control section 113 receives information, from the sheet stopper 104, notifying that the booklet 10 comes into contact with the sheet stopper 104, it controls to terminate conveyance of the booklet 10 by prioritizing such information.

When the conveyance of the booklet 10 is ended, the sheet stopper 104 is moved up to the retracted position 104*b* by the sheet stopper motor 105 and then, the booklet holding member 106 is moved downward by the holding member drive motor 108 so that the booklet 10 is held at both sides thereof between the booklet holding member 106 and the booklet holding member 107 located downward. Because this booklet holding member 107 is supported by a casing of the folded portion flattening device 100 through a spring 109, the booklet 10 is held with a predetermined holding force.

In sync with moving down of the booklet holding member 106, the sheet-like member 112 located at the retracted position (not shown) is moved by the holding member drive motor 108 to the actuation position as shown in FIG. 5, that is, a predetermined position in front of the folded portion 10*a* of the booklet 10 in the conveyance direction as shown in FIG. 6(*c*). Additionally, the roller 110 is moved by the roller moving motor 111 to a predetermined position in front of the sheet-like member 112 in the conveyance direction. Consequently, the sheet-like member 112 is interposed between the folded portion 10*a* of the booklet 10 and the roller 110.

FIG. 6(*d*) is a view of the folded portion flattening device 100 shown in FIG. 6(*c*) seen from the direction of an arrow E.

The roller 110 runs in the direction of an arrow F, that is, in the longitudinal direction of the folded portion 10*a* of the booklet 10 while rotating around a rotary axis 110*a* as shown in FIG. 6(*d*) so as to press the front end of the folded portion 10*a* of the booklet 10 held by the booklet holding members 106, 107 in an opposite direction to the conveyance direction A. Consequently, the curve at the front end of the folded portion 10*a* of the booklet 10 is flattened to form the flat face 10*e* thereon (see FIG. 3(*c*)).

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical embodiments and with the various modification as are suited to the particular use contemplated. It is intended that the scope of the invention be defined by the following claims and their equivalents.

What is claimed is:

1. A folded portion flattening device comprising:

a sheet conveying section that conveys a booklet of folded sheets in a predetermined conveyance direction with a folded portion ahead;

a sheet stopper that stops the booklet conveyed by the sheet conveying section at a fixed position;

a pair of booklet holding members that hold the booklet stopped by the sheet stopper by gripping the booklet at both faces of the booklet;

a roller that runs in a longitudinal direction of the folded portion of the booklet held by the pair of booklet holding members while rotating and pressing a front end of the folded portion of the booklet in an opposite direction to the conveyance direction, so that a curve at the front end of the folded portion of the booklet is flattened to form a flat face; and a sheet-like member that is disposed, when the roller rotates and presses the front end of the folded portion of the booklet held by the pair of booklet holding members, between the front end of the folded portion of the booklet and the roller in such a manner that the sheet-like member contacts both the front end the folded portion of the booklet and the roller, and prevents the roller from directly contacting the booklet, wherein one of the pair of booklet holding members moves back and forth between a holding position, in which the booklet is held by the pair of booklet holding members, and a non-holding position, in which the hold of the pair of booklet holding members on the booklet is released, and the sheet-like member moves, synchronously with the back and forth movement of the one of the pair of booklet holding members, between an actuation position, in which the sheet-like member contacts both the front end of the booklet and the roller, and a retracted position, in which the sheet-like member is in non-contact with the booklet, the one of the pair of booklet holding members moves from the non-holding position to the holding position when the booklet is stopped at the fixed position by the sheet stopper, and the sheet-like member moves, synchronously with the movement of the one of the pair of booklet holding members from the non-holding position to the holding position, from the retracted position to the actuation position, the one of the pair of booklet holding members stays at the holding position and the sheet-like member stays at the actuation position while the roller is rotating and pressing the front end of the folded portion of the booklet, and the one of the pair of booklet holding members moves from the holding position to the non-holding position after the rotation of the roller and the press of the roller on the front end of the folded portion of the booklet is completed, and the sheet-like member moves, synchronously with the movement of the one of the pair of booklet holding members from the holding position to the non-holding position, from the actuation position to the retracted position.

2. A post treatment apparatus comprising:

an intermediate treatment section that folds plural of sheets to produce a booklet;

a sheet conveying section that conveys the booklet created by the intermediate treatment section in a predetermined conveyance direction with a folded portion ahead;

a sheet stopper that stops the booklet conveyed by the sheet conveying section at a fixed position;

a pair of booklet holding members that holds the booklet stopped by the sheet stopper by gripping the booklet at both faces of the booklet;

a roller that runs in a longitudinal direction of the folded portion of the booklet held by the pair of booklet holding members while rotating and pressing a front end of the folded portion of the booklet an opposite direction to the conveyance direction, so that a curve at the front end of the folded portion of the booklet is flattened to form a flat face; and a sheet-like member that is disposed, when the roller rotates and presses the front end of the folded portion of the booklet held by the pair of booklet holding members, between the front end of the folded portion of the booklet and the roller in such a manner that the sheet-like member contacts both the front end of the folded portion of the booklet and the roller, and prevents the roller from directly contacting the booklet, wherein one of the pair of booklet holding members moves back and forth between a holding position, in which the booklet is held by the pair of booklet holding members, and a non-holding position, in which the hold of the pair of booklet holding members on the booklet is released, and the sheet-like member moves, synchronously with the back and forth movement of the one of the pair of booklet holding members, between an actuation position, in which the sheet-like member contacts both the front end of the booklet and the roller, and a retracted position, in which the sheet-like member is in non-contact with the booklet, the one of the pair of booklet holding members moves from the non-holding position to the holding position when the booklet is stopped at the fixed position by the sheet stopper, and the sheet-like member moves, synchronously with the movement of the one of the pair of booklet holding members from the non-holding position to the holding position, from the retracted position to the actuation position, the one of the pair of booklet holding members stays at the holding position and the sheet-like member stays at the actuation position while the roller is rotating and pressing the front end of the folded portion of the booklet, and the one of the pair of booklet holding members moves from the holding position to the non-holding position after the rotation of the roller and the press of the roller on the front end of the folded portion of the booklet is completed, and the sheet-like member moves, synchronously with the movement of the one of the pair of booklet holding members from the holding position to the non-holding position, from the actuation position to the retracted position.

3. An image forming apparatus comprising:

an image forming section that forms an image on a sheet;

an intermediate treatment section that folds plural of sheets that the image is formed on by the image forming section;

a sheet conveying section that conveys the booklet created by the intermediate treatment section in a predetermined conveyance direction with a folded portion ahead;

a sheet stopper that stops the booklet conveyed by the sheet conveying section at a fixed position;

a pair of booklet holding members that hold the booklet stopped by the sheet stopper by gripping the booklet at both faces of the booklet;

a roller that runs in a longitudinal direction of the folded portion of the booklet held by the pair of booklet holding members while rotating and pressing a front end of the folded portion of the booklet in an opposite direction to the conveyance direction, so that a curve at the front end of the folded portion of the booklet is flattened to form a flat face; and a sheet-like member roller rotates and presses the front end of the folded portion of the booklet held by the pair of booklet holding members, between the front end of the folded portion of the booklet and the roller in such a manner that the sheet-like member contacts both the front end of the folded portion of the booklet and the roller, and prevents the roller from directly contacting with the booklet, wherein one of the pair of booklet holding members moves back and forth between a holding position, in which the booklet is held by the pair of booklet holding members, and a non-holding position, in which the hold of the pair of booklet holding members on the booklet is released, and the sheet-like member moves, synchronously with the back and forth movement of the one of the pair of booklet holding members, between an actuation position, in which the sheet-like member contacts both the front end of the booklet and the roller, and a retracted position, in which the sheet-like member is in non-contact with the booklet, the one of the pair of booklet holding members moves from the non-holding position to the holding position when the booklet is stopped at the fixed position by the sheet stopper, and the sheet-like member moves, synchronously with the movement of the one of the pair of booklet holding members from the non-holding position to the holding position, from the retracted position to the actuation position, the one of the pair of booklet holding members stays at the holding position and the sheet-like member stays at the actuation position while the roller is rotating and pressing the front end of the folded portion of the booklet, and the one of the pair of booklet holding members moves from the holding position to the non-holding position after the rotation of the roller and the press of the roller on the front end of the folded portion of the booklet is completed, and the sheet-like member moves, synchronously with the movement of the one of the pair of booklet holding members from the holding position to the non-holding position, from the actuation position to the retracted position.

* * * * *